US009775754B1

(12) United States Patent
Al-Nasseri et al.

(10) Patent No.: US 9,775,754 B1
(45) Date of Patent: Oct. 3, 2017

(54) CONVERTIBLE WHEELCHAIR

(71) Applicant: SULTAN QABOOS UNIVERSITY, Muscat (OM)

(72) Inventors: Basim Khalfan Hamed Al-Nasseri, Muscat (OM); Yousuf Salim Al-Mushakeri, Muscat (OM); Mustafa Suleiman Al-Shuaili, Muscat (OM)

(73) Assignee: SULTAN QABOOS UNIVERSITY, Muscat (OM)

( * ) Notice: Subject to any disclaimer, the term of this patent is extended or adjusted under 35 U.S.C. 154(b) by 0 days.

(21) Appl. No.: 15/599,435

(22) Filed: May 18, 2017

(51) Int. Cl.
*A61G 5/00* (2006.01)
*A61G 5/10* (2006.01)
*A61G 5/12* (2006.01)

(52) U.S. Cl.
CPC ..... *A61G 5/006* (2013.01); *A61G 5/1067* (2013.01); *A61G 5/127* (2016.11)

(58) Field of Classification Search
CPC ..... A61G 5/006
See application file for complete search history.

(56) References Cited

U.S. PATENT DOCUMENTS

| | | | | |
|---|---|---|---|---|
| 2,383,340 | A * | 8/1945 | Pezzano | A47B 83/04 280/43.16 |
| 4,285,541 | A | 8/1981 | Onishi | |
| 4,797,960 | A | 1/1989 | Vaiana et al. | |
| 4,997,200 | A | 3/1991 | Earls | |
| 5,333,887 | A | 8/1994 | Luther | |
| 5,659,910 | A | 8/1997 | Weiss | |
| 7,306,251 | B2 * | 12/2007 | Bright | A61G 5/1054 280/304.1 |
| 8,104,121 | B2 * | 1/2012 | Bourgraf | A61G 1/017 5/613 |
| 8,187,156 | B2 | 5/2012 | Hochberg et al. | |
| 8,359,685 | B2 | 1/2013 | Patwardhan | |
| 8,516,630 | B2 | 8/2013 | Gugliotti et al. | |
| 8,950,776 | B2 | 2/2015 | Tsukada et al. | |
| 2006/0113746 | A1 | 6/2006 | Bright et al. | |
| 2017/0035633 | A1 * | 2/2017 | Amin | A61G 7/018 |

FOREIGN PATENT DOCUMENTS

| | | |
|---|---|---|
| CN | 204932034 U | 1/2016 |
| CN | 205198314 U | 5/2016 |
| JP | 2007229427 A | 9/2007 |

OTHER PUBLICATIONS

"Power Options"; printed from https://www.magicmobility.com.au/wheelchairs/wheelchair-options/power-options/ on Mar. 29, 2017; 10 pages.

* cited by examiner

*Primary Examiner* — Kevin Hurley
(74) *Attorney, Agent, or Firm* — Richard C. Litman

(57) ABSTRACT

The convertible wheelchair is similar to a conventional wheelchair, but includes a reclining back support and an additional leg support plate. As the back support is pivoted, with respect to the seat, into a reclining position, the leg support plate is driven to pivot upward. When the back support is pivoted into a fully reclining position, the seat, the back support and the leg support plate are positioned parallel and co-planar with respect to one another. Similar to a conventional wheelchair, the convertible wheelchair includes a frame, the seat, which is secured to an upper end of the frame, the back support, which is secured to a rear end of the frame and is pivotally coupled to the seat, a pair of rear wheels rotatably secured to the rear end of the frame, and a pair of front wheels rotatably secured to the front end of the frame.

19 Claims, 7 Drawing Sheets

CONVERTIBLE WHEELCHAIR

BACKGROUND OF THE INVENTION

1. Field of the Invention

The present invention relates generally to wheelchairs, and particularly to a convertible wheelchair which may be used in a manner similar to a conventional wheelchair or may be converted into a table or gurney-like support for the patient.

2. Description of the Related Art

In the medical field, several types of conveyances or conveyance devices are utilized to transport the infirm, geriatric, or patient from one location to another. One such device is the well-known wheelchair. Most wheelchairs basically include a chair on wheels that can be manually propelled, motor driven or pushed by an assistant. These conveyances are a great benefit to the caregiver or medical staff in most situations, but can be potential hindrances in times of emergencies or for purposes of general hygiene. In emergency situations, any loss of time due to handling and removing the injured from a wheelchair can be potentially fatal, especially when the injured is in a sitting position. In situations where a caregiver must assist the infirm or geriatric with hygienic functions, such as elimination of bodily wastes or bathing, maneuvering the patient in and out of a wheelchair can be an awkward and strenuous exercise, which can lead to potentially embarrassing moments.

Additionally, conventional wheelchairs, due to their typically rigid and static frames, can cause the user to experience discomfort and injury. Due to limitations in the user's movements, a patient may be forced, by the design of the wheelchair, to sit in one position for an extended period of time. Such limited freedom of positioning for the user not only causes back pains, bedsores and assorted injuries and discomforts, but makes it difficult for the patient to receive additional care, such as, for example, receiving injections or other treatments, as well as therapeutic exercises for maintaining proper muscle function and blood circulation. Thus, a convertible wheelchair solving the aforementioned problems is desired.

SUMMARY OF THE INVENTION

The convertible wheelchair is similar to a conventional wheelchair, but includes a reclining back support and an additional leg support plate. As the back support is pivoted, with respect to the seat, into a reclining position, the leg support plate is driven to pivot upward. When the back support is pivoted into a fully reclining position, the seat, the back support and the leg support plate are positioned parallel and co-planar with respect to one another. Similar to a conventional wheelchair, the convertible wheelchair includes a frame, the seat, which is secured to an upper end of the frame, the back support, which is secured to a rear end of the frame and is pivotally coupled to the seat, a pair of rear wheels rotatably secured to the rear end of the frame, and a pair of front wheels rotatably secured to the front end of the frame.

An additional leg is further provided. The leg has a fixed end and a free end, with the fixed end being pivotally secured to a rear surface of the back support. An auxiliary wheel is rotatably mounted on the free end of the leg. When the back support is lowered into its fully reclined position, the auxiliary wheel touches the floor and the leg provides additional support and stability for the now-horizontal back support.

A gear housing is secured to the frame, beneath the seat. A rack gear, having opposed first and second ends, is further provided, with the first end thereof being slidably received in the gear housing. An orthogonal joint is slidably mounted on the leg, with the second end of the rack gear being secured to the orthogonal joint. Thus, as the leg raises and lowers due to pivoting of the back support with respect to the seat, the rack gear is driven to slide back and forth in the gear housing. A pinion gear is mounted on the gear housing and is driven to rotate by the linear movement of the rack gear. A first drive gear is coupled to the pinion gear and is driven to rotate by rotation of the pinion gear. A second drive gear is coupled to the first drive gear, by a chain or the like, and is driven to rotate by rotation of the first drive gear. The leg support plate has opposed fixed and free ends, and the fixed end thereof is coupled to the second drive gear such that the leg support plate is driven to rotate by rotation of the second drive gear. It should be understood that rotation of the back support with respect to the seat may be driven by a motor.

In use, when the back support is pivoted downwardly towards a reclining position, the rack gear slides within the gear housing, driving the pinion gear to drive rotation of the first drive gear. Rotation of the first drive gear drives rotation of the second drive gear which, in turn, drives rotation of the leg support plate. When the back support is pivoted into a fully reclining position, the seat, the back support and the leg support plate are positioned parallel and co-planar with respect to one another. Preferably, an additional leg, having an auxiliary wheel, is also provided. When the back support is lowered into its fully reclined position, the auxiliary wheel touches the floor and the leg provides additional support and stability for the now-horizontal back support.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
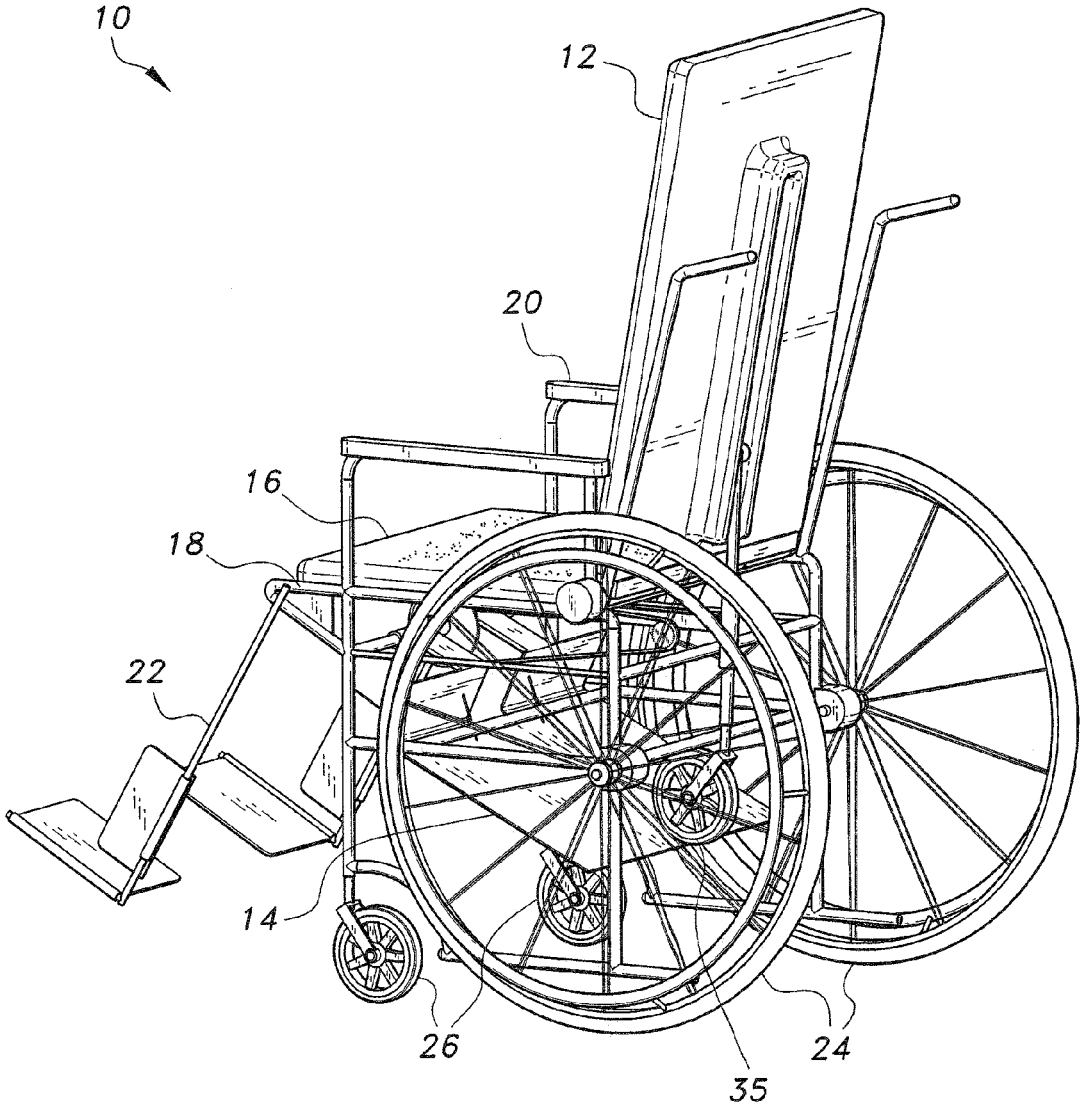
FIG. 1A is a perspective view of a convertible wheelchair according to the present invention, shown in an upright configuration.
Figure 1B:
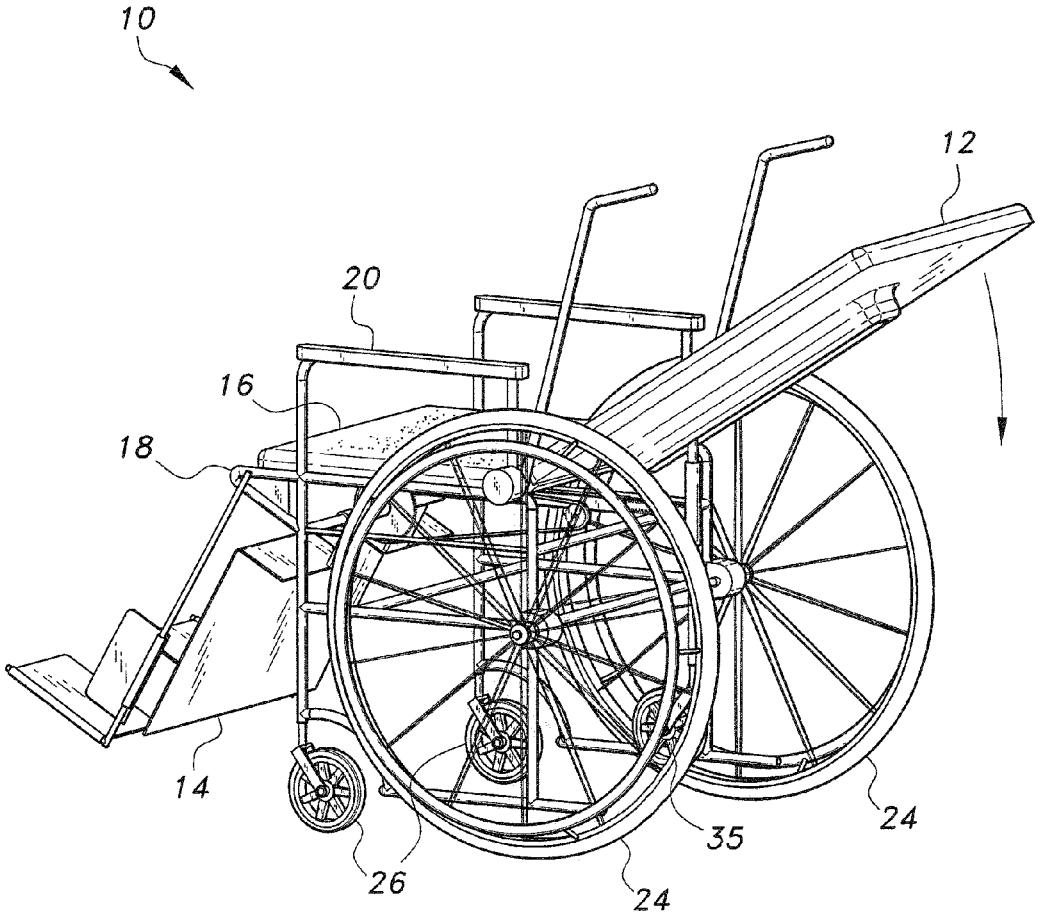
FIG. 1B is a perspective view of the convertible wheelchair according to the present invention, shown in an intermediate configuration.
Figure 1C:
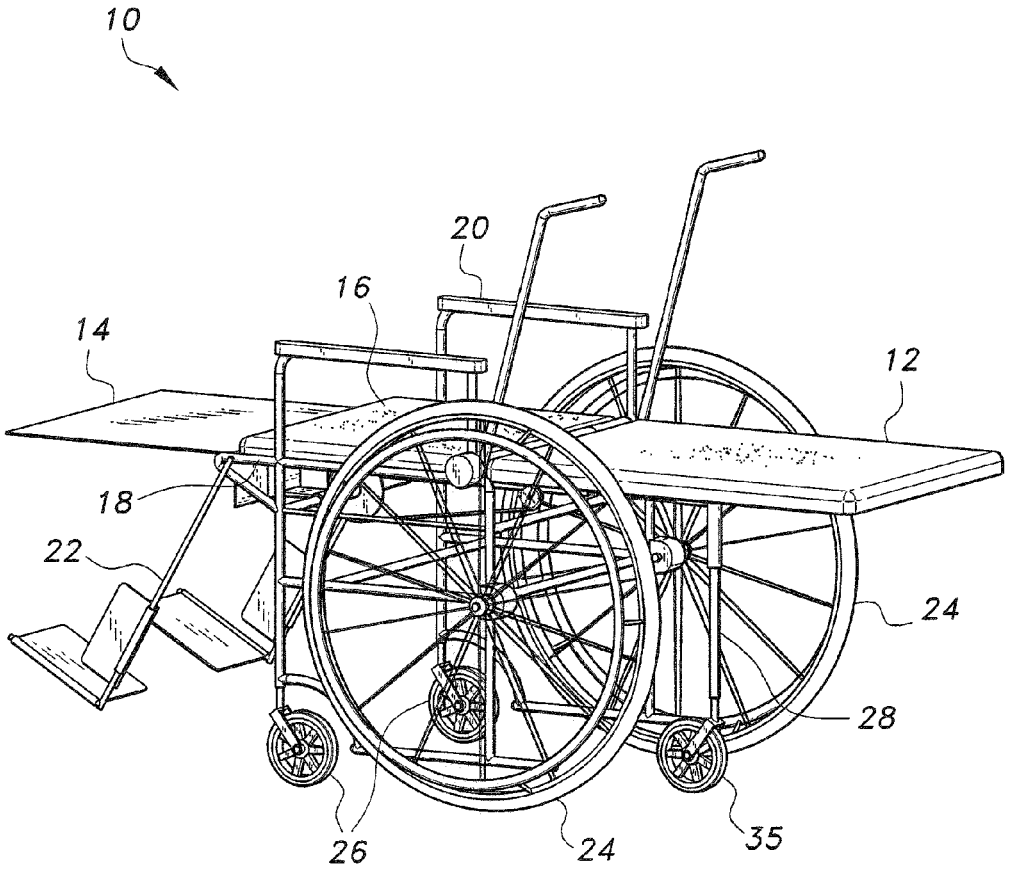
FIG. 1C is a perspective view of the convertible wheelchair according to the present invention, shown in a reclining configuration.

Referring now to FIGS. 1A-1C, it can be seen that convertible wheelchair 10 is similar to a conventional wheelchair, but includes a reclining back support 12 and an additional leg support plate 14. FIG. 1A shows the convertible wheelchair 10 in an initial position, in which convertible wheelchair 10 may be used in a manner similar to a conventional wheelchair. As shown in FIG. 1B, back support 12 may be pivoted with respect to seat 16. As the back support 12 is pivoted, with respect to seat 16, into a reclining position, the leg support plate 14 is driven to pivot upward in a manner which will be described in greater detail below. As shown in FIG. 1C, when the back support 12 is pivoted into a fully reclining position, the seat 16, the back support 12 and the leg support plate 14 are positioned parallel and co-planar with respect to one another. In the fully upright position of FIG. 1A, the leg support plate 14 is hidden beneath seat 16, thus not making any contact with the legs of the user; i.e., in this position, the convertible wheelchair 10 supports the user in a conventional manner.

Similar to a conventional wheelchair, the convertible wheelchair 10 also includes a frame 18, the seat 16, which is secured to an upper end of the frame 18, the back support 12, which is secured to a rear end of the frame 18 and is pivotally coupled to the seat 16, arm rests 20, leg rests 22, a pair of rear wheels 24 rotatably secured to the rear end of the frame 18, and a pair of front wheels 26 rotatably secured to the front end of the frame 18.

Figure 2:
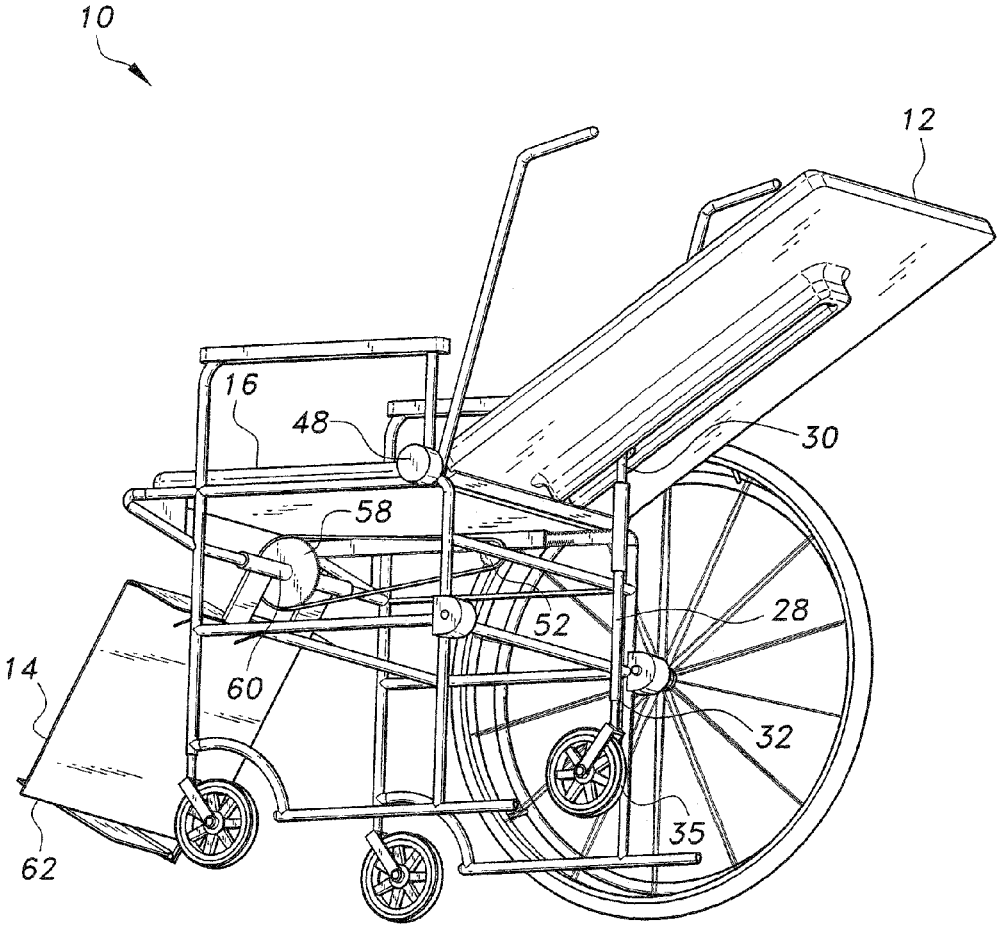
FIG. 2 is a partial perspective view of the convertible wheelchair according to the present invention.
Figure 4:
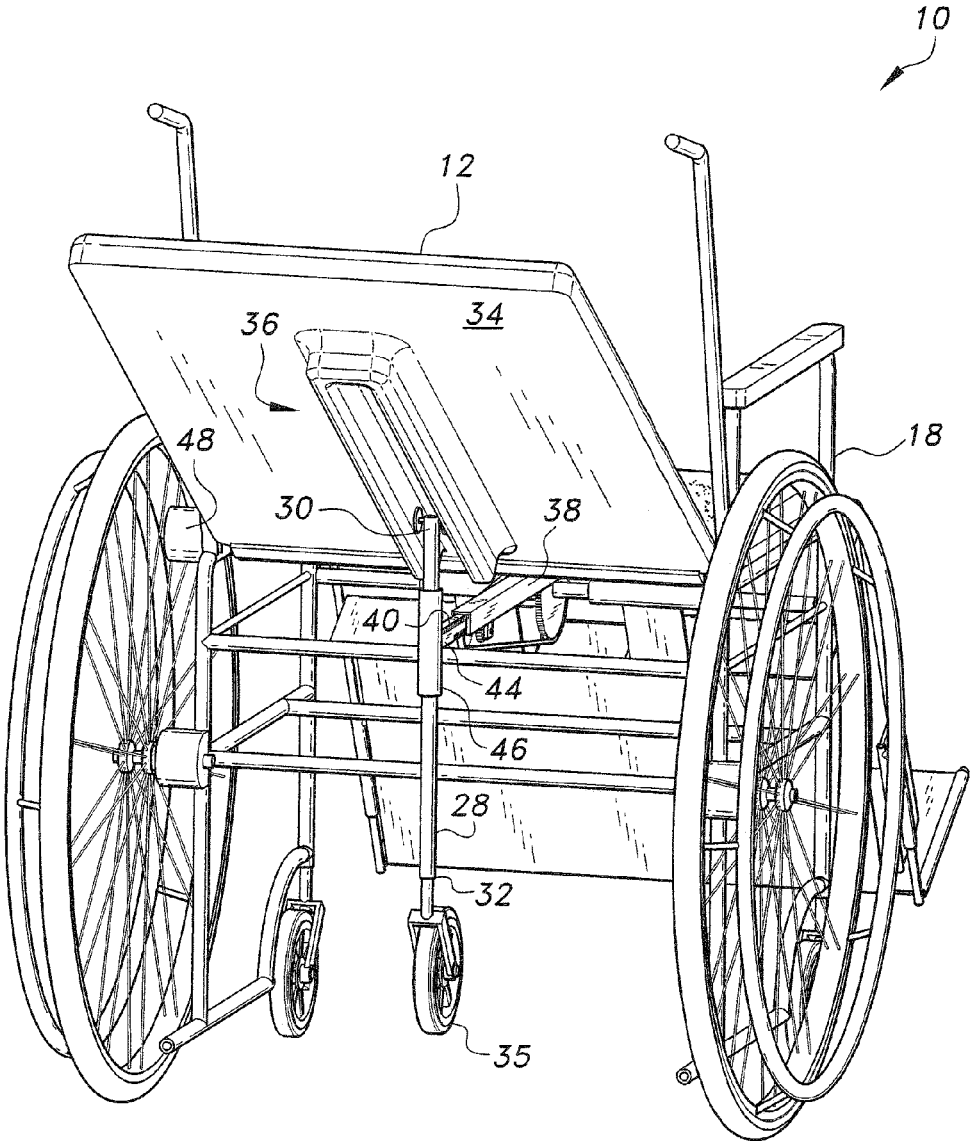
FIG. 4 is a rear, partial perspective view of the convertible wheelchair.

As best shown in FIGS. 2 and 4, an additional leg 28 is further provided. The leg 28 has a fixed end 30 and a free end 32, with the fixed end 30 being pivotally secured to a rear surface 34 of the back support 12. As best seen in FIG. 4, a recess 36 may be formed in the rear surface 34 of back support 12, with fixed end 30 of leg 28 being secured to the rear surface 34 within the recess 36. When the back support 12 is in the upright position of FIG. 1A, the leg 28 is received within, and is held in place by, recess 36. Further, an auxiliary wheel 35 is rotatably mounted on the free end 32 of the leg 28. When the back support 12 is lowered into its fully reclined position, the auxiliary wheel 35 touches the floor and the leg 28 provides additional support and stability for the now-horizontal back support 12.

Figure 3:
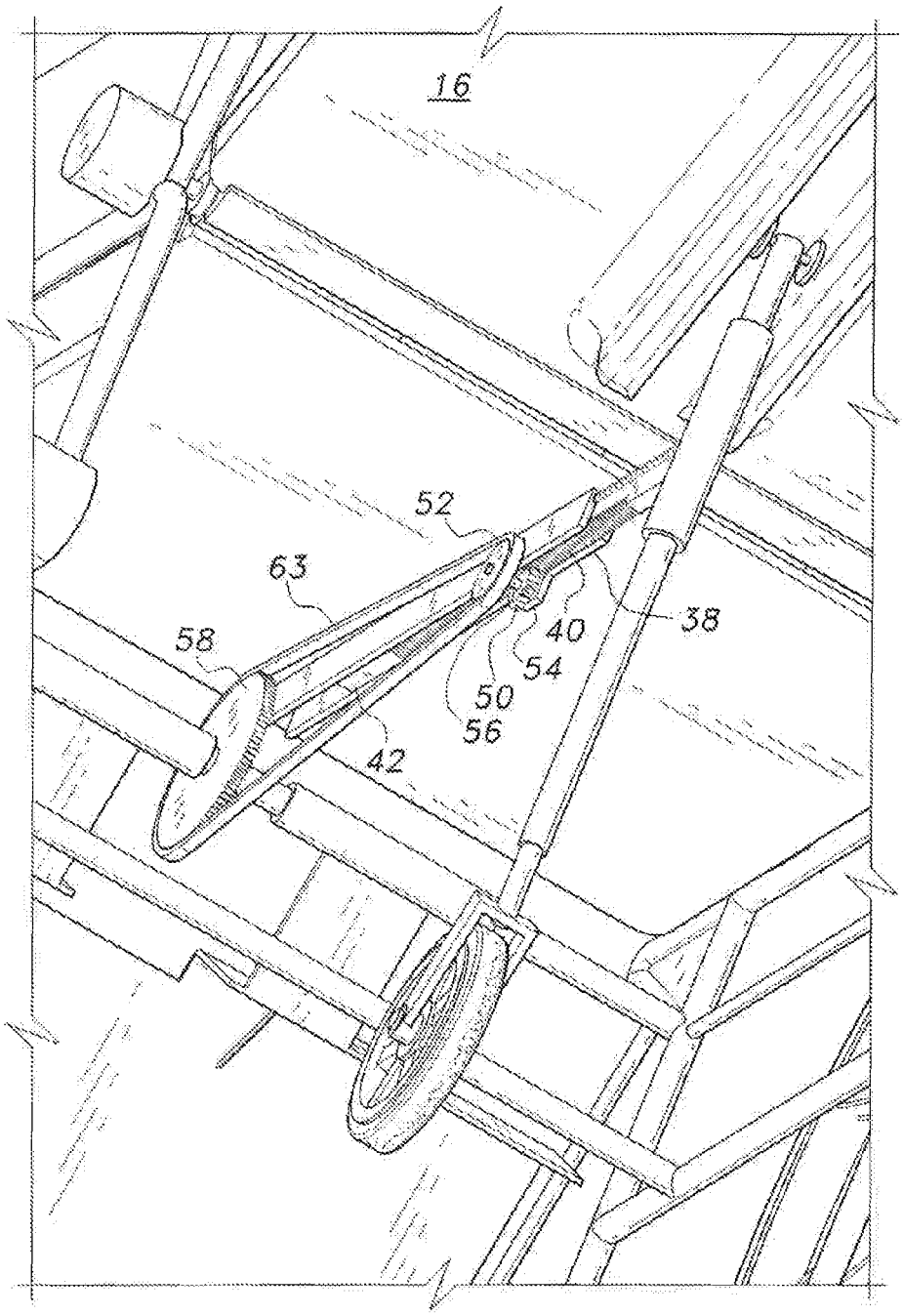
FIG. 3 is a perspective view of a drive mechanism of the convertible wheelchair.

As shown in FIGS. 3 and 4, a gear housing 38 is secured to the frame 18, beneath the seat 16. A rack gear 40, having opposed first and second ends, 42, 44, respectively is further provided, with the first end 42 being slidably received in the gear housing 38. As best shown in FIG. 4, an orthogonal joint 46 is slidably mounted on the leg 28, with the second end 44 of the rack gear 40 being secured to the orthogonal joint 46. Thus, as the leg 28 raises and lowers due to pivoting of the back support 12 with respect to the seat 16, the rack gear 40 is driven to slide back and forth in the gear housing 38. It should be understood that rotation of back support 12 with respect to seat 16 may be driven by a motor 48. In addition, or alternatively, rotation can be driven manually or by any suitable type of rotational drive or actuator. The orthogonal joint 46 secures the leg 28; i.e., provides support to prevent leg 28 from slippage and misalignment.

A pinion gear 50 is mounted on the gear housing 38 and is driven to rotate by the linear movement of the rack gear 40. A first drive gear 52 is coupled to the pinion gear 50 and is driven to rotate by rotation of the pinion gear 50 which, in turn, is driven to rotate by rack gear 40. As shown, bracket 54 is mounted to the gear housing 38, with an axle 56 being rotatably mounted to the bracket 54. The pinion gear 50 is secured to one end of the axle 56 and the first drive gear 52 is secured to an opposing end of the axle 56.

A second drive gear 58 is coupled to the first drive gear 52, by a chain 63, toothed belt or the like as best seen in FIG. 3, and is driven to rotate by rotation of the first drive gear 52. It should be understood that first drive gear 52 and second drive gear 58, along with their linkages, are not shown in FIG. 4 for purposes of clarity and simplification only. As best seen in FIG. 2, the leg support plate 14 has opposed fixed and free ends, 60, 62, respectively, and the fixed end 60 is coupled to the second drive gear 58 such that the leg support plate 14 is driven to rotate by rotation of the second drive gear 58.

In use, when the back support 12 is pivoted downwardly towards a reclining position, the rack gear 40 slides within the gear housing 38, driving the pinion gear 50 to drive rotation of the first drive gear 52. Rotation of the first drive gear 52 drives rotation of the second drive gear 58 which, in turn, drives rotation of the leg support plate 14. When the back support 12 is pivoted into a fully reclining position, as in FIG. 1C, the seat 16, the back support 12 and the leg support plate 14 are positioned parallel and co-planar with respect to one another.

It should be understood that the overall configuration and relative dimensions of convertible wheelchair 10 may be varied, dependent on size, shape, style and intended function(s) of the wheelchair. As an example only, the maximum elongated length of rack gear 40 may be approximately 30 cm when extended into the fully reclined position of FIG. 1C. From the position of FIG. 1A to the position of FIG. 1C, the leg support plate 14 may rotate through an exemplary arc of approximately 140°. Using these exemplary data, the radius of second drive gear 58 may be approximately 12.3 cm, and the radius of first drive gear 52 may be approximately 3.0 cm.

Figure 5:
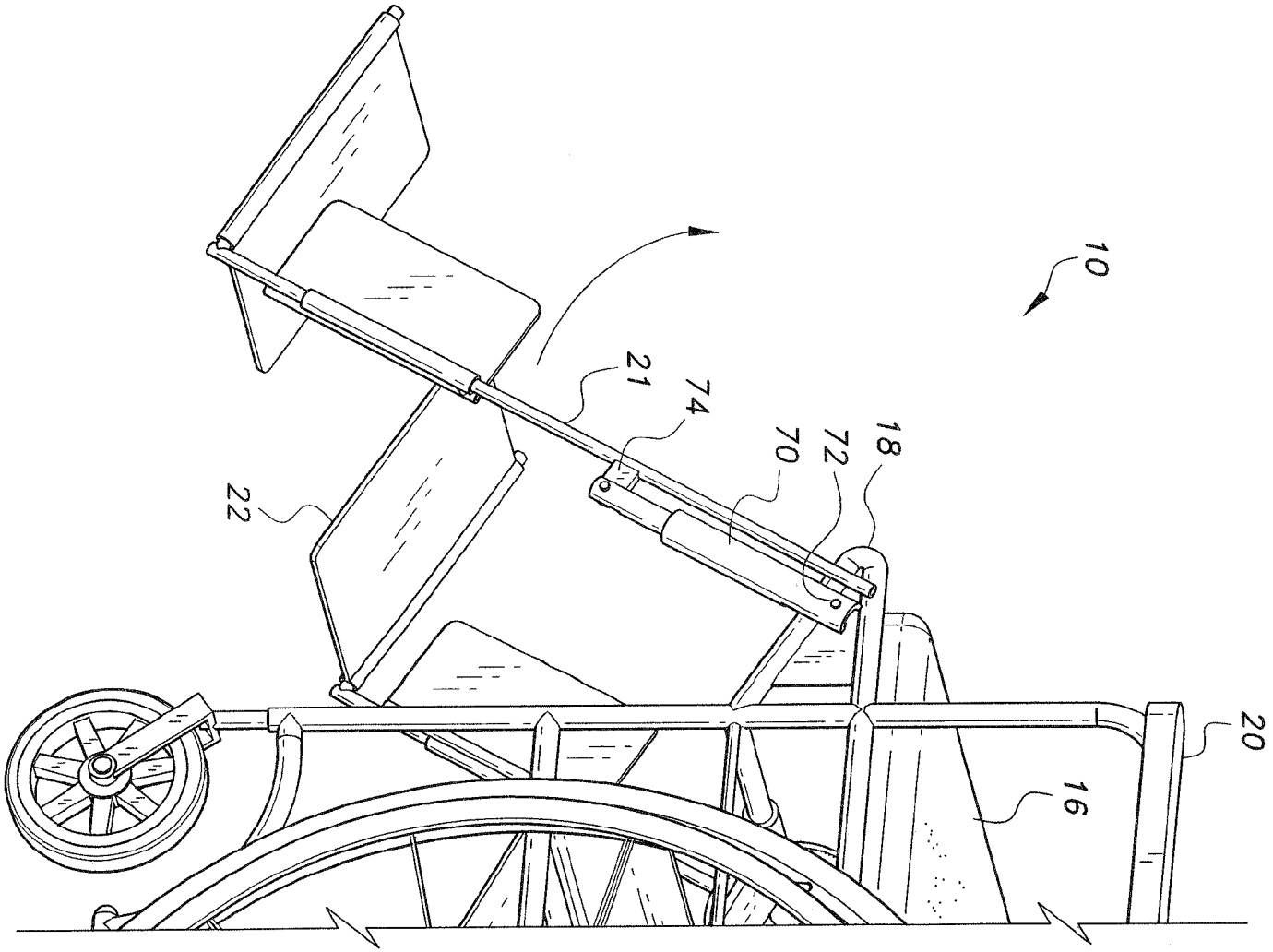
FIG. 5 is a perspective view of an alternative embodiment of the convertible wheelchair.

As shown in the alternative embodiment of FIG. 5, a linear actuator 70 or the like may be pivotally mounted at one end 72 to frame 18, and pivotally mounted at an opposing end 74 to a substantially central portion of leg rest 22. As linear actuator 70 expands and contracts in length, the leg rest 22 will rise and fall, providing the user with leg exercise. It should be understood that any suitable type of linear actuator, drive or the like may be used, and may be powered and controlled by any suitable type of power and control system.

For an exemplary, initial, fully contracted length of linear actuator 70 of 4 cm, an exemplary maximum extension of approximately 14 cm would fully raise leg rest 22 to an approximately horizontal position. For a full arc of movement of approximately 88°, linear actuator 70 would apply approximately 79.43 N of force, assuming a user of an average weight of 90 kg.

It is to be understood that the present invention is not limited to the embodiments described above, but encompasses any and all embodiments within the scope of the following claims.

We claim:

1. A convertible wheelchair, comprising:

a frame;

a seat secured to said frame;

a back support secured to said frame and being pivotally coupled to said seat;

a pair of rear wheels rotatably secured to a rear portion of said frame;

a pair of front wheels rotatably secured to a front portion of said frame;

a leg support plate having a fixed end and a free end;

a leg having a fixed end and a free end, the fixed end thereof being secured to a rear surface of said back support;

an auxiliary wheel rotatably mounted on the free end of said leg;

a gear housing secured to said frame;

a rack gear having opposed first and second ends, the first end thereof being slidably received in said gear housing;

an orthogonal joint slidably mounted on said leg, the second end of said rack gear being secured to said orthogonal joint;

a pinion gear mounted on said gear housing and being driven to rotate by linear movement of said rack gear;

a first drive gear coupled to said pinion gear and being driven to rotate by rotation of said pinion gear; and a second drive gear coupled to said first drive gear and being driven to rotate by rotation of said first drive gear, the fixed end of said leg support plate being coupled to said second drive gear such that said leg support plate is driven to rotate by rotation of said second drive gear, whereby when said back support is pivoted downwardly towards a reclining position, said rack gear slides within said gear housing, driving said pinion gear to drive rotation of said first drive gear, the rotation of said first drive gear driving rotation of said second drive gear, and the rotation of said second drive gear driving rotation of said leg support plate, such that when said back support is pivoted into a fully reclining position, said seat, said back support and said leg support plate are positioned parallel and co-planar with respect to one another.

2. The convertible wheelchair as recited in claim 1, further comprising a chain, wherein the chain couples the first drive gear to the second drive gear.

3. The convertible wheelchair as recited in claim 1, wherein a recess is formed in the rear surface of said back support, the fixed end of said leg being pivotably secured to the rear surface of said back support in the recess.

4. The convertible wheelchair as recited in claim 1, wherein a recess is formed in the rear surface of said back support, the fixed end of said leg being slidably secured to the rear surface of said back support in the recess.

5. The convertible wheelchair as recited in claim 1, further comprising:

a bracket mounted to said gear housing; and an axle rotatably mounted to the bracket, wherein said pinion gear is secured to one end of the axle and said first drive gear is secured to an opposing end of the axle.

6. The convertible wheelchair as recited in claim 1, further comprising at least one leg rest having opposed fixed and free ends, the fixed end thereof being pivotally secured to the front portion of said frame.

7. The convertible wheelchair as recited in claim 6, further comprising at least one linear actuator having opposed first and second ends, the first end thereof being pivotally secured to the front portion of said frame, the second end thereof being pivotally secured to the at least one leg rest.

8. A convertible wheelchair, comprising:

a frame;

a seat secured to said frame;

a back support secured to said frame and being pivotally coupled to said seat;

a pair of rear wheels rotatably secured to a rear portion of said frame;

a pair of front wheels rotatably secured to a front portion of said frame;

at least one leg rest having opposed fixed and free ends, the fixed end thereof being pivotally secured to the front portion of said frame;

a leg support plate having a fixed end and a free end;

a leg having a fixed end and a free end, the fixed end thereof being pivotally secured to a rear surface of said back support;

an auxiliary wheel rotatably mounted on the free end of said leg;

a gear housing secured to said frame;

a rack gear having opposed first and second ends, the first end thereof being slidably received in said gear housing;

an orthogonal joint slidably mounted on said leg, the second end of said rack gear being secured to said orthogonal joint;

a pinion gear mounted on said gear housing and being driven to rotate by linear movement of said rack gear;

a first drive gear coupled to said pinion gear and being driven to rotate by rotation of said pinion gear; and a second drive gear coupled to said first drive gear and being driven to rotate by rotation of said first drive gear, the fixed end of said leg support plate being coupled to said second drive gear such that said leg support plate is driven to rotate by rotation of said second drive gear, whereby when said back support is pivoted downwardly towards a reclining position, said rack gear slides within said gear housing, driving said pinion gear to drive rotation of said first drive gear, the rotation of said first drive gear driving rotation of said second drive gear, and the rotation of said second drive gear driving rotation of said leg support plate, such that when said back support is pivoted into a fully reclining position, said seat, said back support and said leg support plate are positioned parallel and co-planar with respect to one another.

9. The convertible wheelchair as recited in claim 8, further comprising a chain, wherein the chain couples the first drive gear to the second drive gear.

10. The convertible wheelchair as recited in claim 8, wherein a recess is formed in the rear surface of said back support, the fixed end of said leg being pivotally secured to the rear surface of said back support in the recess such that said leg is at least partially removably receivable within the recess.

11. The convertible wheelchair as recited in claim 10, wherein the second end of said rack gear is connected to the orthogonal joint.

12. The convertible wheelchair as recited in claim 8, further comprising:

a bracket mounted to said gear housing; and an axle rotatably mounted to the bracket, wherein said pinion gear is secured to one end of the axle and said first drive gear is secured to an opposing end of the axle.

13. The convertible wheelchair as recited in claim 8, further comprising at least one linear actuator having opposed first and second ends, the first end thereof being pivotally secured to the front portion of said frame, the second end thereof being pivotally secured to the at least one leg rest.

14. A convertible wheelchair, comprising:

a frame;

a seat secured to said frame;

a back support secured to said frame and being pivotally coupled to said seat;

a pair of rear wheels rotatably secured to a rear portion of said frame;

a pair of front wheels rotatably secured to a front portion of said frame;

a leg support plate having a fixed end and a free end;

a leg having a fixed end and a free end, the fixed end thereof being pivotally secured to a rear surface of said back support, wherein a recess is formed in the rear surface of said back support, the fixed end of said leg being pivotally secured to the rear surface of said back support in the recess such that said leg is at least partially removably receivable within the recess;

an auxiliary wheel rotatably mounted on the free end of said leg;

a gear housing secured to said frame;

a rack gear having opposed first and second ends, the first end thereof being slidably received in said gear housing;

an orthogonal joint slidably mounted on said leg, the second end of said rack gear being secured to said orthogonal joint;

a pinion gear mounted on said gear housing and being driven to rotate by linear movement of said rack gear;

a first drive gear coupled to said pinion gear and being driven to rotate by rotation of said pinion gear; and a second drive gear coupled to said first drive gear and being driven to rotate by rotation of said first drive gear, the fixed end of said leg support plate being coupled to said second drive gear such that said leg support plate is driven to rotate by rotation of said second drive gear, whereby when said back support is pivoted downwardly towards a reclining position, said rack gear slides within said gear housing, driving said pinion gear to drive rotation of said first drive gear, the rotation of said first drive gear driving rotation of said second drive gear, and the rotation of said second drive gear driving rotation of said leg support plate, such that when said back support is pivoted into a fully reclining position, said seat, said back support and said leg support plate are positioned parallel and co-planar with respect to one another.

15. The convertible wheelchair as recited in claim 14, further comprising a chain, wherein the chain couples the first drive gear to the second drive gear.

16. The convertible wheelchair as recited in claim 14, wherein the second end of said rack gear is connected to the orthogonal joint.

17. The convertible wheelchair as recited in claim 14, further comprising:

a bracket mounted to said gear housing; and an axle rotatably mounted to the bracket, wherein said pinion gear is secured to one end of the axle and said first drive gear is secured to an opposing end of the axle.

18. The convertible wheelchair as recited in claim 14, further comprising at least one leg rest having opposed fixed and free ends, the fixed end thereof being pivotally secured to the front portion of said frame.

19. The convertible wheelchair as recited in claim 18, further comprising at least one linear actuator having opposed first and second ends, the first end thereof being pivotally secured to the front portion of said frame, the second end thereof being pivotally secured to the at least one leg rest.

* * * * *